US007489275B2

(12) United States Patent
Wan

(10) Patent No.: US 7,489,275 B2
(45) Date of Patent: Feb. 10, 2009

(54) FLAT PANEL ANTENNA

(75) Inventor: Tze-Chung Wan, Jhongli (TW)

(73) Assignee: Joymax Electronics Co., Ltd., Jhongli (TW)

( * ) Notice: Subject to any disclaimer, the term of this patent is extended or adjusted under 35 U.S.C. 154(b) by 7 days.

(21) Appl. No.: 11/603,110

(22) Filed: Nov. 22, 2006

(65) Prior Publication Data

US 2008/0117107 A1 May 22, 2008

(51) Int. Cl.
*H01Q 1/38* (2006.01)

(52) U.S. Cl. ..... 343/700 MS; 343/846

(58) Field of Classification Search ..... 343/700 MS, 343/702, 846, 848

See application file for complete search history.

(56) References Cited

U.S. PATENT DOCUMENTS 4,791,423 A * 12/1988 Yokoyama et al. .... 343/700 MS
6,606,061 B2 * 8/2003 Wong et al. ..... 343/700 MS
7,212,161 B2 * 5/2007 Chen et al. ..... 343/700 MS

* cited by examiner

*Primary Examiner*—HoangAnh T Le
(74) *Attorney, Agent, or Firm*—Troxell Law Office, PLLC

(57) ABSTRACT

A flat panel antenna includes a horizontal ground plan, a vertical ground plane, a radiation metal member disposed over and in parallel with the horizontal ground plane; the vertical ground plane being disposed at a level higher than that of the radiation metal member, an extension member extending from the vertical ground plane in the direction of and in parallel with the radiation metal member to penetrate into the radiation metal member for a proper length for precise control impedance of the antenna for the normalized impedance to approach 1, i.e. 50-ohm of the system impedance of the antenna to upgrade radiation efficiency of the flat panel antenna.

7 Claims, 9 Drawing Sheets

FLAT PANEL ANTENNA

BACKGROUND OF THE INVENTION (a) Field of the Invention

The present invention is related to a flat panel antenna, and more particularly, to one that is capable of precise control of the impedance of the flat panel antenna with a value of normalized impedance approaching 1, i.e., the antenna impedance approaches 50Ω of the system impedance to upgrade radiation efficiency of the flat panel antenna.

(b) Description of the Prior Art

Advanced communication technology has expands its applications in technology products; and communication products also tends to be more diversified making the design and study of antenna even critical in determination of the transmission and receiving quality. The antenna relates to a device to either radiate or receive electron magnetic (EM) waves and generally the features of an antenna can be made clear by its work frequency, radiation pattern, return loss and antenna gain parameters.

A flat panel antenna of the prior art as illustrated in FIG. 1 of the accompanying drawings includes a rectangular radiation metal member 11 as the primary radiation portion of the antenna; a flat ground plane 12; a substrate 14 disposed between the radiation metal member 11 and the ground plane 12; and a feeding device 13 comprised of a feeding cable penetrating through the ground plane 12 to feed upright into the radiation metal member 11 through a metal probe for transmitting signals.

FIG. 2 shows experimental data regarding return loss of the antenna (with a design central frequency at 915 Hz). Wherein Curve A indicates the measured bandwidth of the flat panel antenna; and the return loss of the central frequency of the antenna is approximately −14 dB (referring to Point A1) that is close to the reference generally acceptable in the trade (−10 dB). According to the experimental data of Smith Impedance of the flat panel antenna as given in FIG. 3, Curve B indicates impedance covered by the flat panel antenna with the impedance of the central frequency of the antenna staying far away from 1 (referring to Point B1), i.e., the impedance of the antenna is far away from 50 Ω of the system impedance. Both of return loss and impedance of the flat panel antenna of the prior art though meet the criteria generally acceptable in the trade, fail to comply with strict requirements of an antenna with exact specifications, e.g., the one for the substrate station or Radio Frequency Identification(RFID) READER. Furthermore, the radiation efficiency of the flat panel antenna of the prior art is also comparatively poor due to its greater impedance.

SUMMARY OF THE INVENTION

The primary purpose of the present invention is to provide a flat panel antenna allowing precise control of antenna impedance to such that the normalized impedance approaches 1, i.e., the antenna impedance to approach 50-ohm of the system impedance for upgrading radiation efficiency, permitting wider work bandwidth, and reduced return loss.

To achieve the purpose, the present invention includes a horizontal ground plan, a vertical ground plane, a radiation metal member disposed over and in parallel with the horizontal ground plane; wherein, the vertical ground plane being disposed at a level higher than that of the radiation metal member, an extension member extending from the vertical ground plane in the direction of and in parallel with the radiation metal member to penetrate into the radiation metal member for a proper length for precise control impedance of the antenna.

DETAILED DESCRIPTION OF THE PREFERRED EMBODIMENTS

Figure 1:
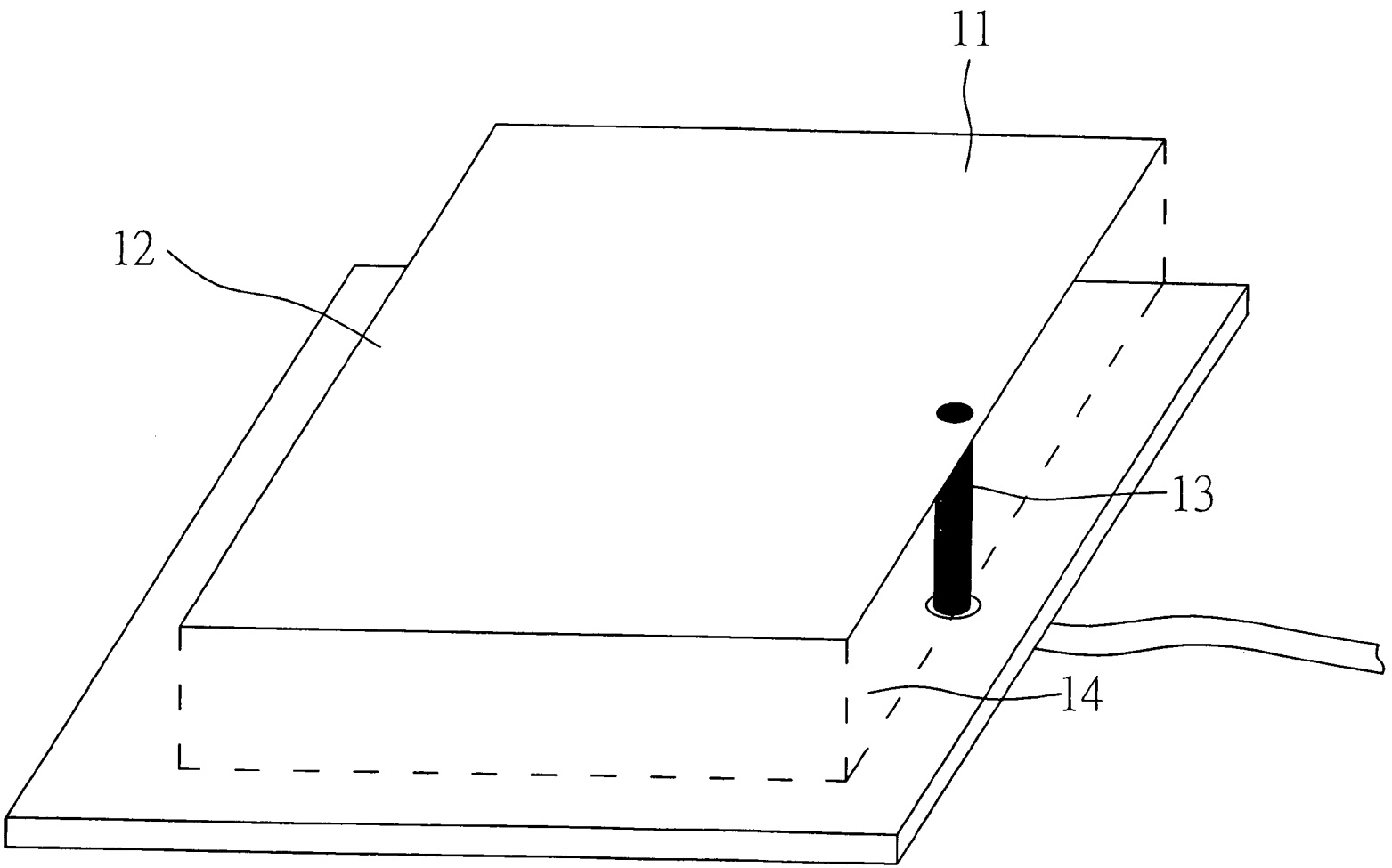
FIG.1 Prior Art
FIG. 1 is a perspective view of a flat panel antenna of the prior art.
Figure 2:
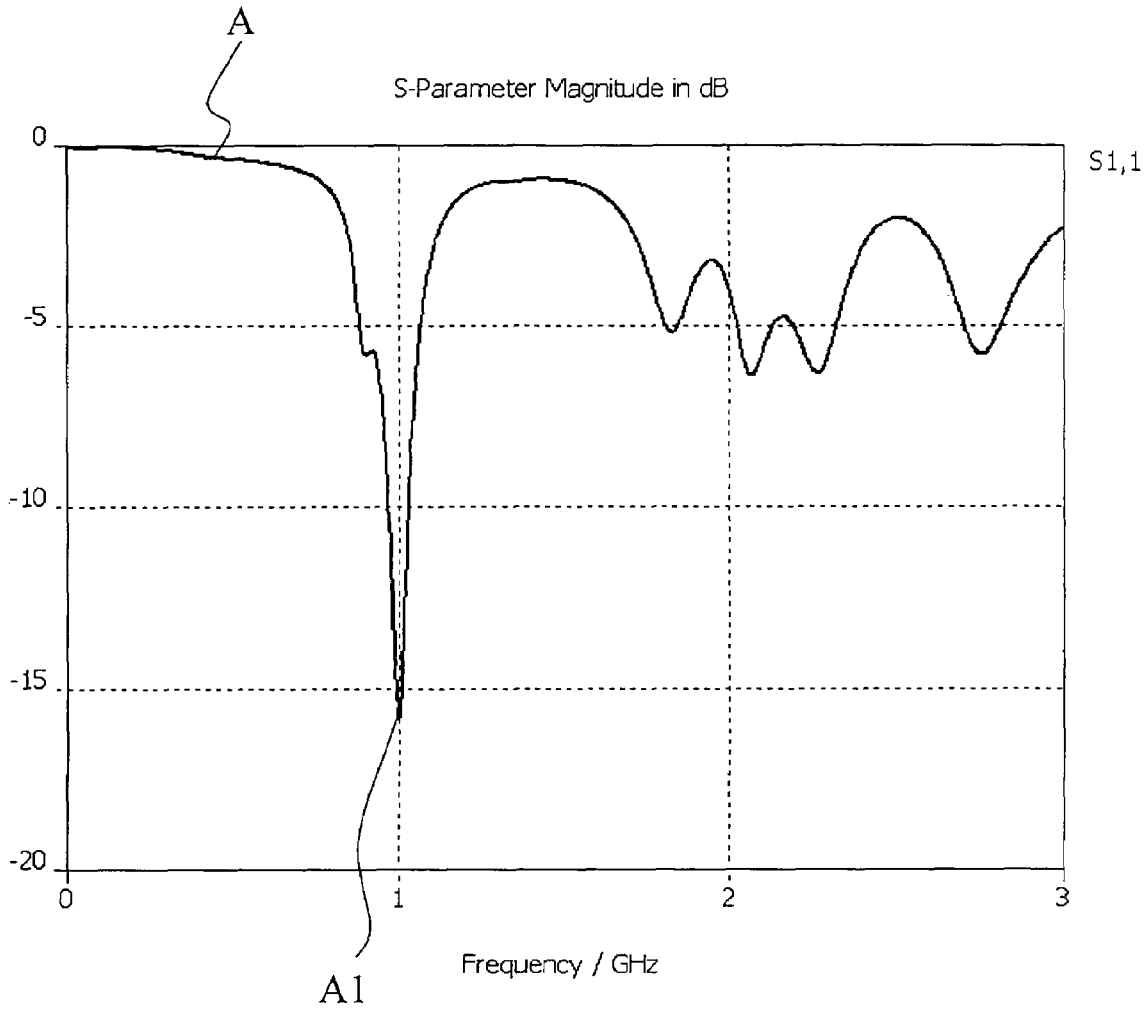
FIG.2 Prior Art
FIG. 2 lists experimental data of return loss of the prior art.
Figure 3:
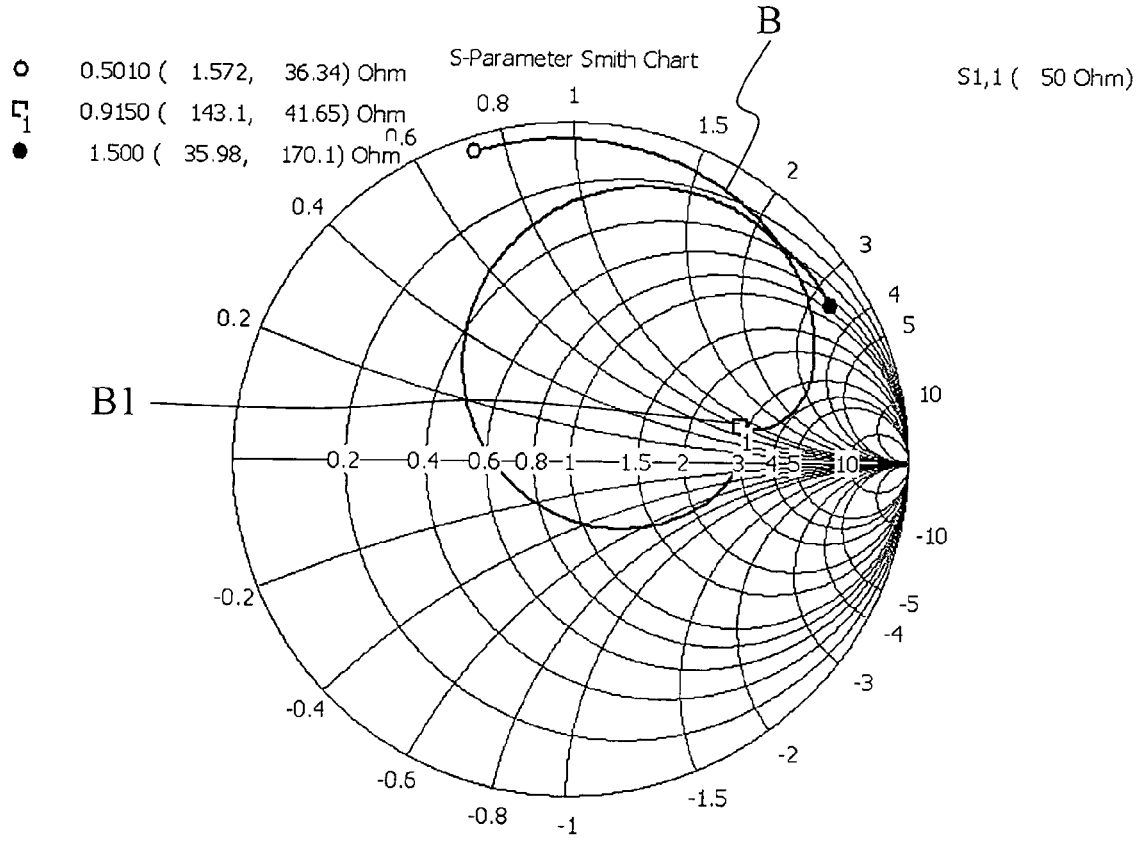
FIG.3 Prior Art
FIG. 3 lists experimental data of Smith impedance of the prior art.
Figure 4:
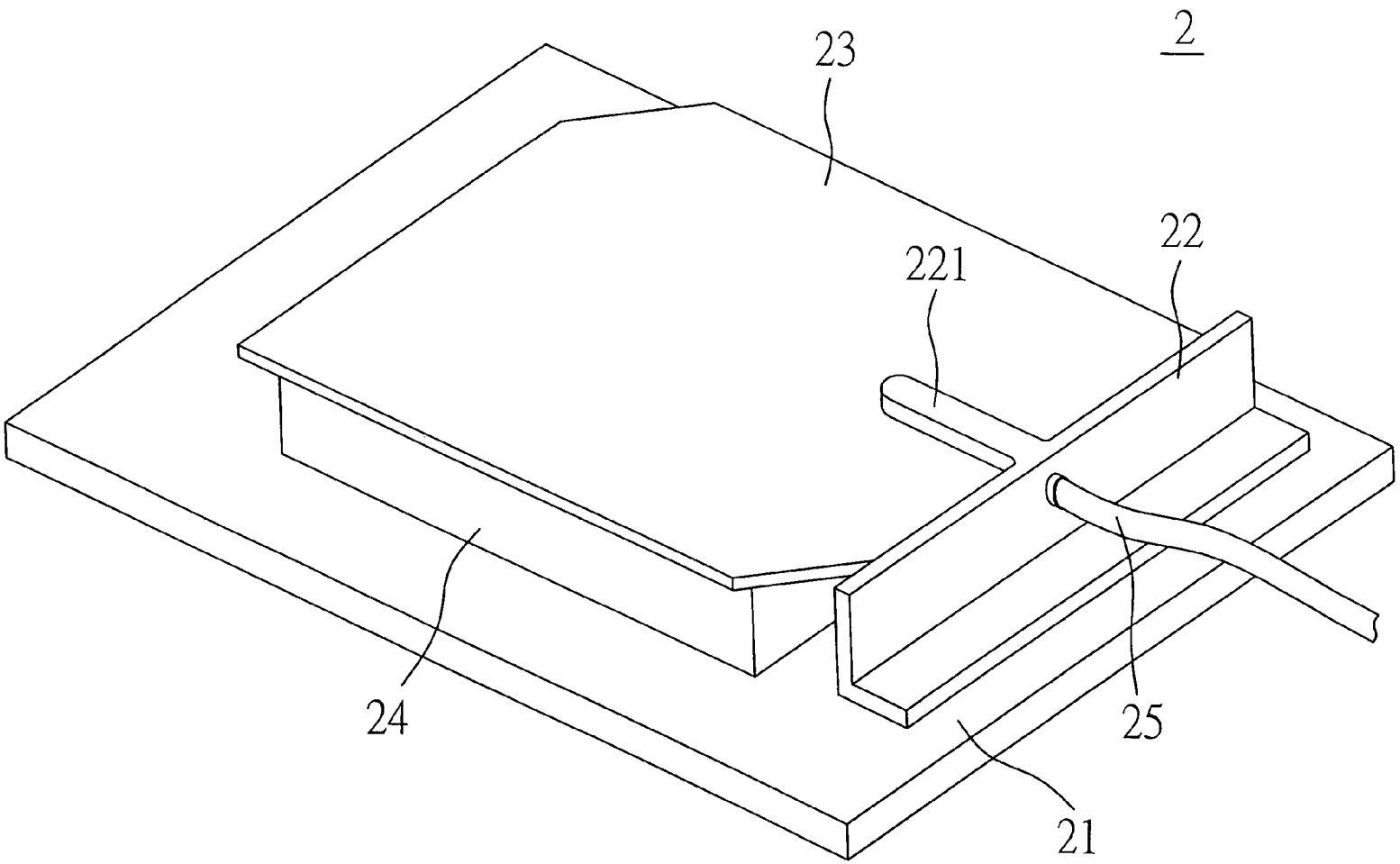
FIG. 4 is a perspective view of a preferred embodiment of the present invention.
Figure 5:
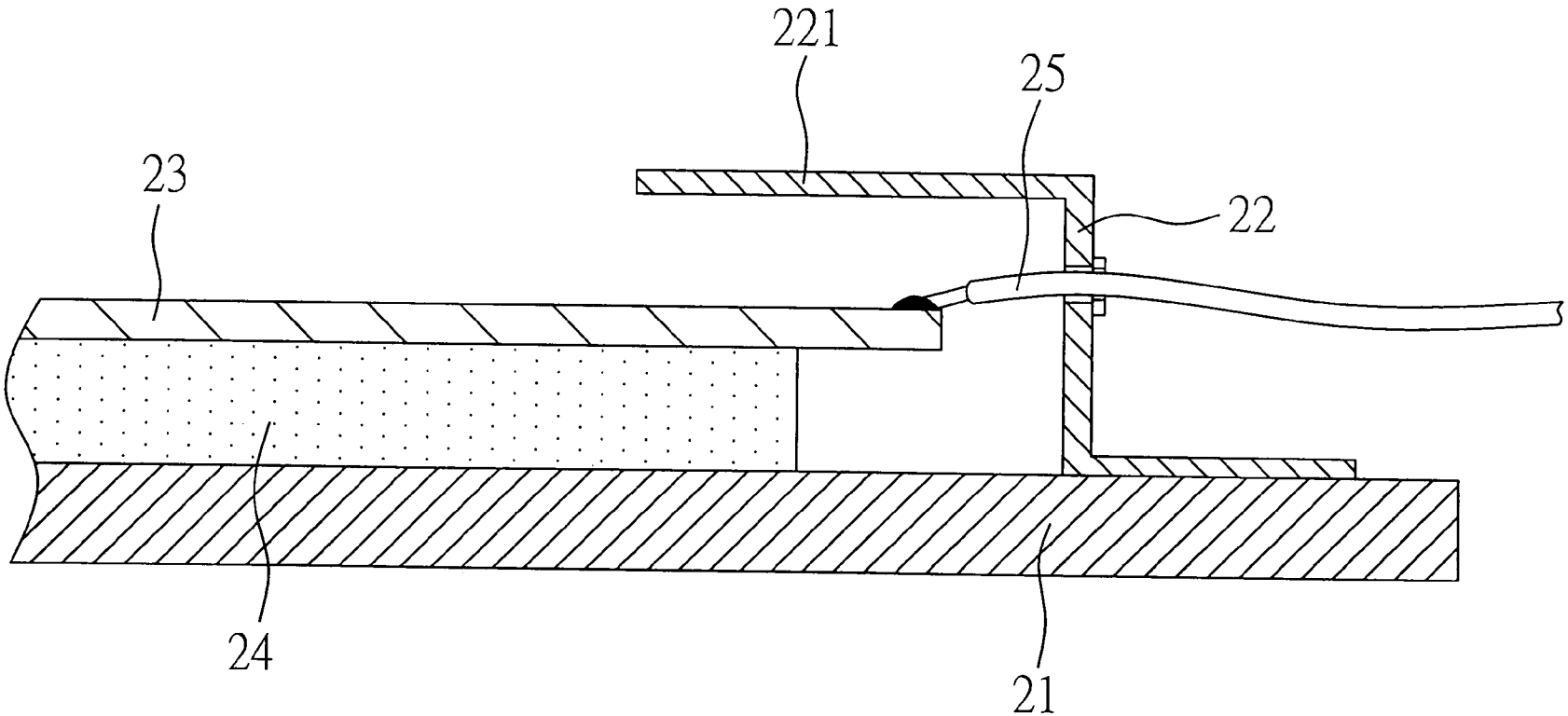
FIG. 5 is a schematic view showing construction of the preferred embodiment of the present invention.

Referring to FIGS. 4 and 5 for a preferred embodiment of the present invention, a flat panel antenna 2 includes a vertical ground plane 22 and a horizontal ground plane 21 disposed at a right angle to each other with both planes 21, 22 made of metal or other conductive device; a radiation metal member 23 in square provided with a pair of diagonal cutting angles is disposed above and in parallel with the horizontal ground plane 21; a substrate 24 relates to air with a dielectric constant approaching 1 or to a medium with its dielectric constant close to the air is disposed between the horizontal ground plane 21 and the radiation metal member 23; and a feeding device 25 for signal transmission penetrates through the vertical ground plane 22 to connect to the radiation metal member 23.

The vertical ground plane 22 is disposed at a level higher than that of the radiation metal member 23. An extension member 221 extends from the vertical ground plane 22 facing the direction of and in parallel with the radiation metal member 23 to penetrate into the radiation metal member 23 for a proper length. The length of the extension member 221 penetrating into the radiation metal member 23 allows precise control of the impedance of the flat panel antenna to such extent that the normalized impedance is approaching 1, i.e., the impedance of the antenna approaches 50-ohm of the system impedance, in a simple construction to permit easy of impedance adjustment.

Figure 6:
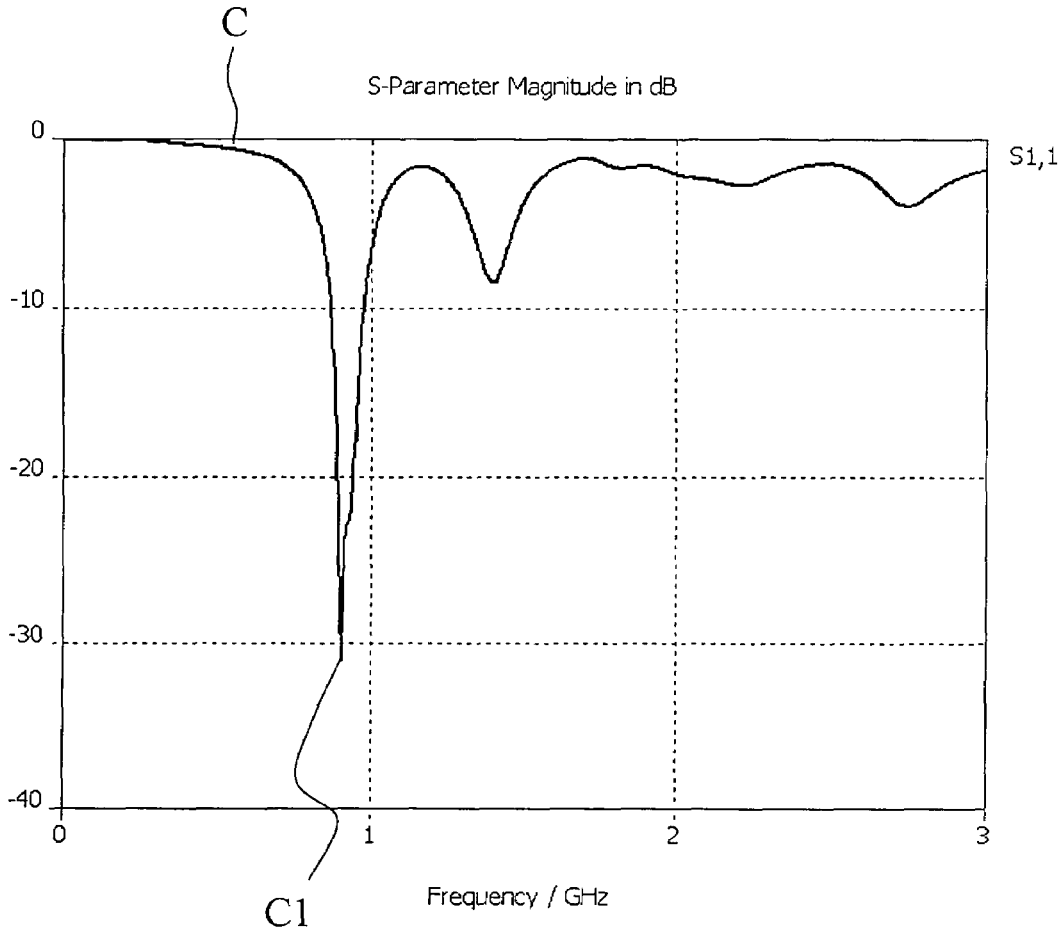
FIG. 6 lists experimental data of return loss of the preferred embodiment of the present invention.

According to FIG. 6, Curve C in the experimental data of return loss of the flat panel antenna of the present invention (with a design central frequency at 915 MHz) indicates the measured impedance bandwidth of the flat panel antenna. The return loss of the central frequency of the antenna is approximately −30 dB (reference point C1) that is much lower than the reference of −10 dB generally acceptable in the trade to evidence the flat panel antenna of the present invention is provided with excellent return loss specifications and comparatively wider work bandwidth.

Figure 7:
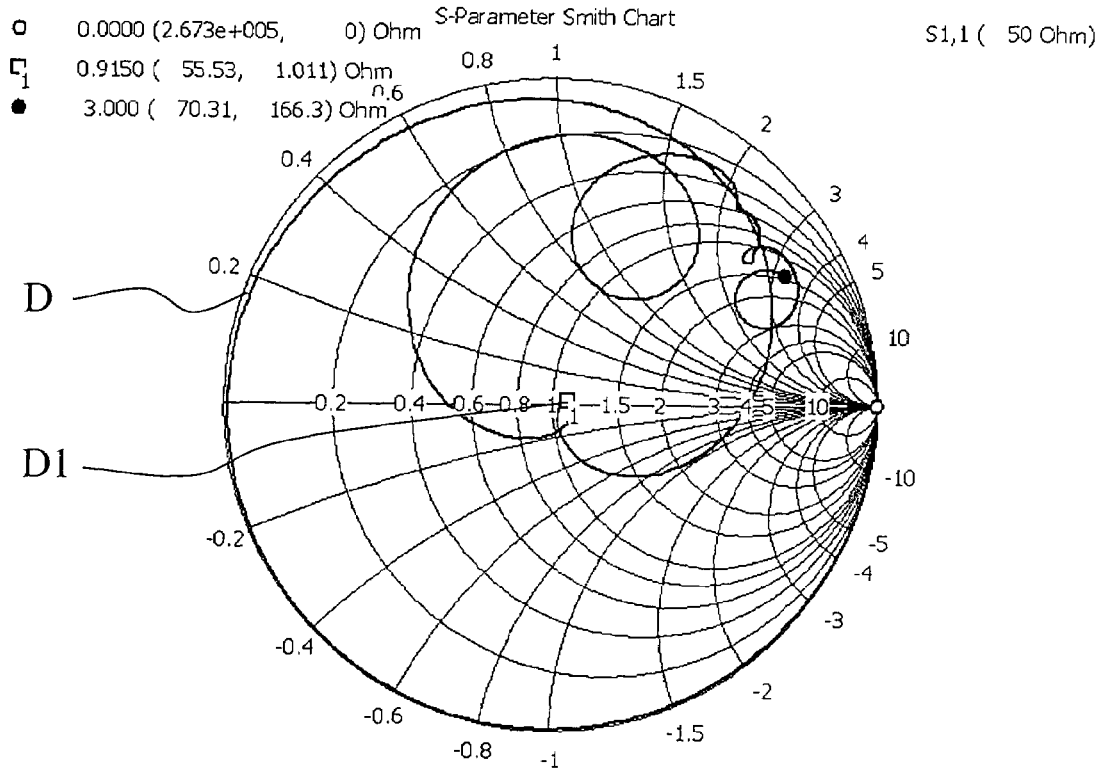
FIG. 7 lists experimental data of Smith impedance of the preferred embodiment of the present invention.

The present invention also provides better radiation efficiency. According to the experimental data of Smith Impedance of the present invention given in FIG. 7, Curve D represents the impedance covered by the flat panel antenna with a comparatively smaller impedance of the central frequency of the antenna to approach 1 (reference point D1).

Figure 8:
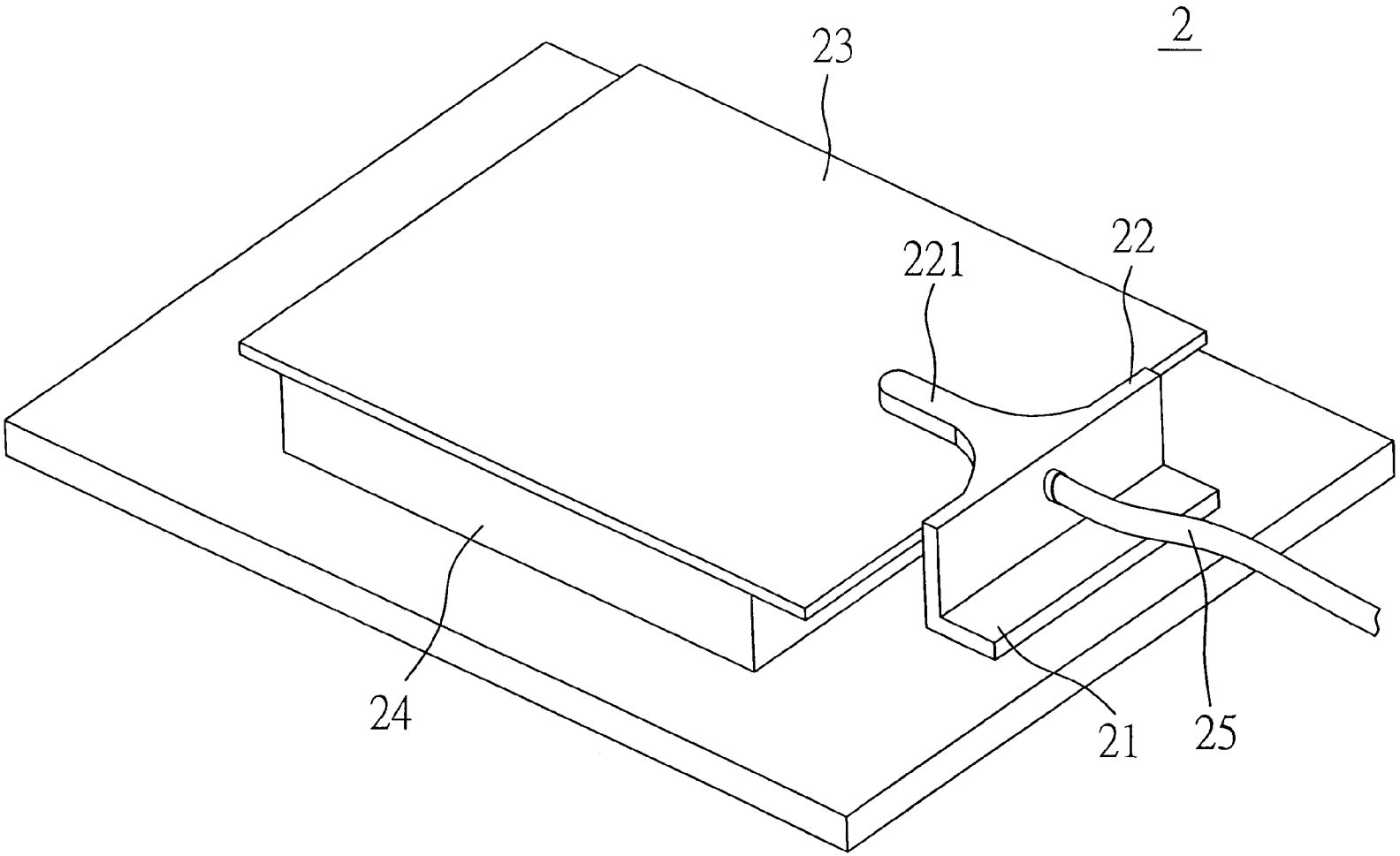
FIG. 8 is a perspective view of another preferred embodiment of the present invention.
Figure 9:
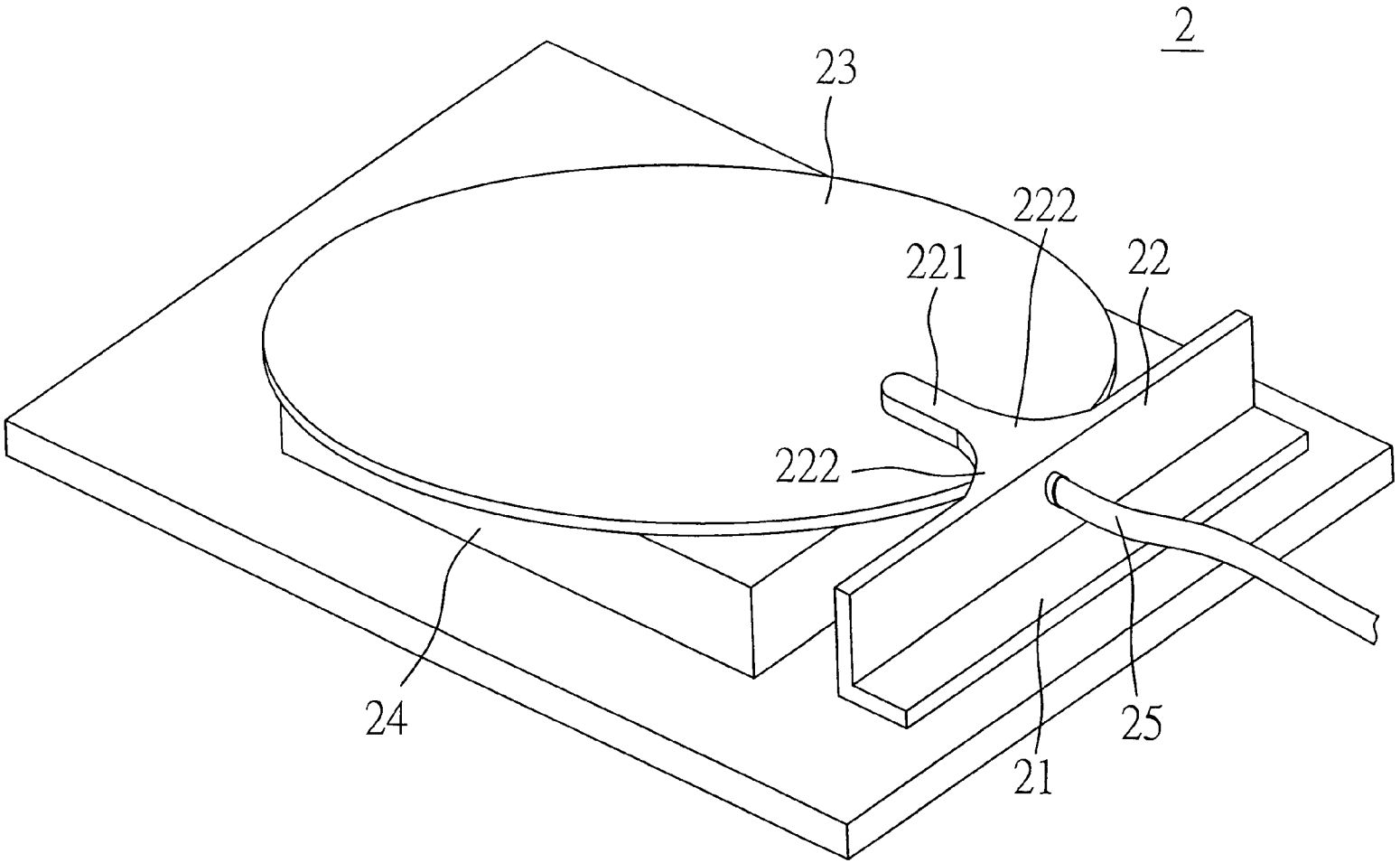
FIG. 9 is a perspective view of another preferred embodiment yet of the present invention.

Furthermore, the radiation metal member 23 may be made in other form than a square. As illustrated in FIG. 8, the radiation metal member is made in rectangular; the length of the vertical ground plane 22 is made shorter than that of the radiation metal member 23; and a chamfer 222 is formed at where the vertical ground plane 22 contracts the extension member 221. Alternatively as illustrated in FIG. 9, the radiation metal member 23 is related to a closed arc sheet metal and the chamfer 222 is also provided at where the vertical ground plane 22 contacts the extension member 221 to achieve the same purpose of upgrading radiation efficiency of the flat panel antenna.

The prevent invention provides an improved structure of a flat panel antenna, and the application for a utility patent is duly filed accordingly. However, it is to be noted that the preferred embodiments disclosed in the specification and the accompanying drawings are not limiting the present invention; and that any construction, installation, or characteristics that is same or similar to that of the present invention should fall within the scope of the purposes and claims of the present invention.

I claim:

1. A flat panel antenna including a horizontal ground plane; a vertical ground plane disposed at a right angle to the horizontal ground plane; a substrate disposed above the horizontal ground plane; a radiation metal member disposed over the substrate and in parallel with the horizontal ground plane; and a feeding member penetrating through the vertical ground plane and connected to the radiation metal member; the vertical ground plane being disposed at a level higher than that of the radiation metal member; an extension member extending from the vertical ground plane toward and in parallel with the radiation metal member; and the extension member partially overlying the radiation metal plate for a selected length, wherein a size of the selected length overlying the radiation metal member controls an impedance of the flat panel antenna.

2. The flat panel antenna as claimed in claim 1, wherein both of the horizontal and vertical ground planes are metal members.

3. The flat panel antenna as claimed in claim 1, wherein the substrate relates to air with its dielectric constant approaching 1, or a medium with its dielectric constant close to air.

4. The flat panel antenna as claimed in claim 1, wherein the radiation metal member is a square sheet metal provided with a pair of diagonal cut angles.

5. The flat panel antenna as claimed in claim 1, wherein the radiation metal member is provided in a form other than a square one.

6. The flat panel antenna as claimed in claim 1, wherein the length of the vertical ground plane is shorter than that of the radiation metal member.

7. The flat panel antenna as claimed in claim 1, wherein a chamfer is defined at where the vertical ground plane contacts the extension member.

* * * * *